US006164047A

United States Patent [19]

Rossi

[11] Patent Number: 6,164,047

[45] Date of Patent: Dec. 26, 2000

[54] METHOD AND DEVICE FOR CUTTING FILM USED TO WRAP GROUPS OF PRODUCTS

[75] Inventor: Bruno Rossi, Rimini, Italy

[73] Assignee: Robopac, S.A., Falciano, San Marino

[21] Appl. No.: 09/269,442

[22] PCT Filed: Jul. 29, 1998

[86] PCT No.: PCT/IB98/01155

§ 371 Date: Mar. 26, 1999

§ 102(e) Date: Mar. 26, 1999

[87] PCT Pub. No.: WO99/06279

PCT Pub. Date: Feb. 11, 1999

[30] Foreign Application Priority Data

Aug. 1, 1997 [IT] Italy ..... BO97A0482

[51] Int. Cl.[7] ..... B65B 27/00

[52] U.S. Cl. ..... 53/587; 53/556

[58] Field of Search ..... 53/587, 399, 441, 53/556, 211

[56] References Cited

U.S. PATENT DOCUMENTS

| | | | |
|---|---|---|---|
| 4,563,863 | 1/1986 | Humphrey | 53/587 |
| 4,845,920 | 7/1989 | Lancaster | 53/587 |
| 5,385,001 | 1/1995 | Ramer | 53/587 |
| 5,430,995 | 7/1995 | Cere | 53/587 |
| 5,941,049 | 8/1999 | Lancaster, III | 53/587 |

*Primary Examiner*—Stephen F. Gerrity
*Assistant Examiner*—Sam Tawfik
*Attorney, Agent, or Firm*—Fay, Sharpe, Fagan, Minnich & McKee, LLP

[57] ABSTRACT

A device and method for cutting and re-attaching film for wrapping groups of palletized products are provided. Following the wrapping of a pack, the width of the section of film extending between a reel and the pack is reduced, using an assembly that defines a band of film with minimum width that, at least at one point, is coplanar with a rotating platform. The section of film is then gripped by a gripper and cutting unit. The gripper and cutting unit are attached to the outer edge of the platform. The section of film is then cut by the cutting unit following rotation of the platform.

15 Claims, 9 Drawing Sheets

METHOD AND DEVICE FOR CUTTING FILM USED TO WRAP GROUPS OF PRODUCTS

TECHNICAL FIELD

The present invention relates to a method and the relative device for cutting and re-attaching film used to wrap groups of products. In particular this unit can be applied to machines for the semi-automatic wrapping of packs of products arranged on pallets for transportation of the packs.

BACKGROUND ART

In the sector for the design and construction of machines for wrapping packs of products, manufacturers have, over time, used two different construction philosophies, which have led to the definition of two types of machines, respectively automatic and semi-automatic.

These two types originate from a similar basic structure which comprises a support platform for the pallet upon which the group of products to be wrapped rests, and a frame, at the side of the platform, upon which a reel of film for wrapping the group of products is positioned.

In the case of automatic machines, there are solutions which envisage a rotating platform and in which the reel only moves vertically up and down in order to unwind the film along the group of products, or solutions with a fixed platform and a reel which moves vertically and is supported by an arm which rotates about the group of products.

In semi-automatic machines, the first type of system described above for automatic machines is normally used, that is to say, with the rotating platform and a reel which moves in both directions along a vertical axis; these two machines are basically differentiated by the fact that the automatic machines can carry out a series of cycle start and end operations (for example, positioning the free edge of the film near the pack, cutting the film upon completion of wrapping and sealing the edge on the pack thus defined, etc.) using automatic devices and without the direct action of operators on the machine; in contrast, in the case of semi-automatic machines, operators are required in order to carry out said operations.

Obviously, these differences mean that the automatic machines are very expensive, used only for high productivity and are top of the range, whilst the semi-automatic machines are economically better suited to companies with medium-small production levels.

SUMMARY OF THE INVENTION

In order to bring the two types of machines closer together, the Applicant has designed a method for cutting the film and the relative device which makes the cut and re-attaches the film for semi-automatic machines, with which it is possible to automate the film cutting and re-attachment operation without significantly affecting the cost of the machine and leaving the structure and functions of the current semi-automatic machine unchanged.

BRIEF DESCRIPTION OF THE DRAWINGS

The technical features of the present invention, in accordance with the afore-mentioned aims, are described in the claims herein, and the advantages of the invention are more clearly described in the detailed description below with reference to the accompanying drawings, which illustrate a preferred embodiment, and in which:

DETAILED DESCRIPTION OF PREFERRED EMBODIMENTS

Figure 1:
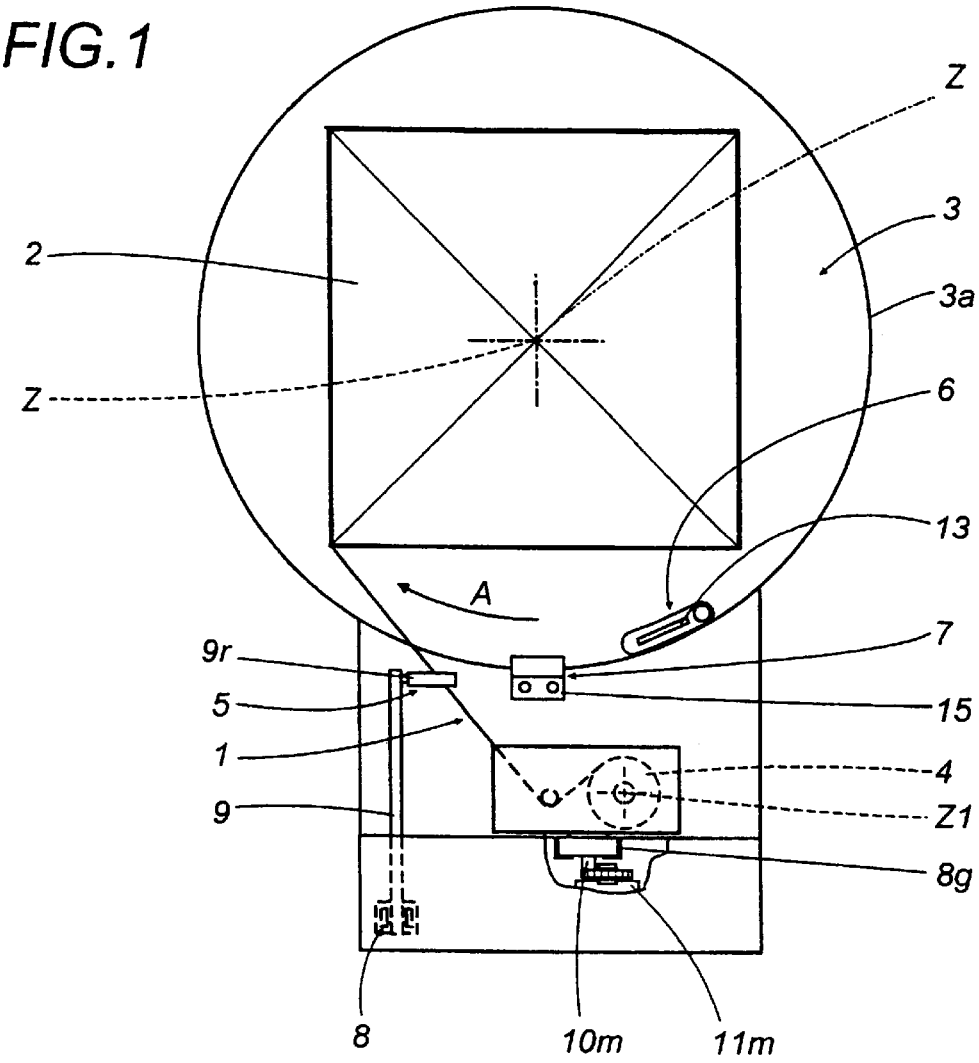
FIG. 1 is a schematic top plan view, with some parts cut away to better illustrate others, of a machine for wrapping groups of products in a plastic film, equipped with the device which carries out the cutting according to the present invention.
Figure 2:
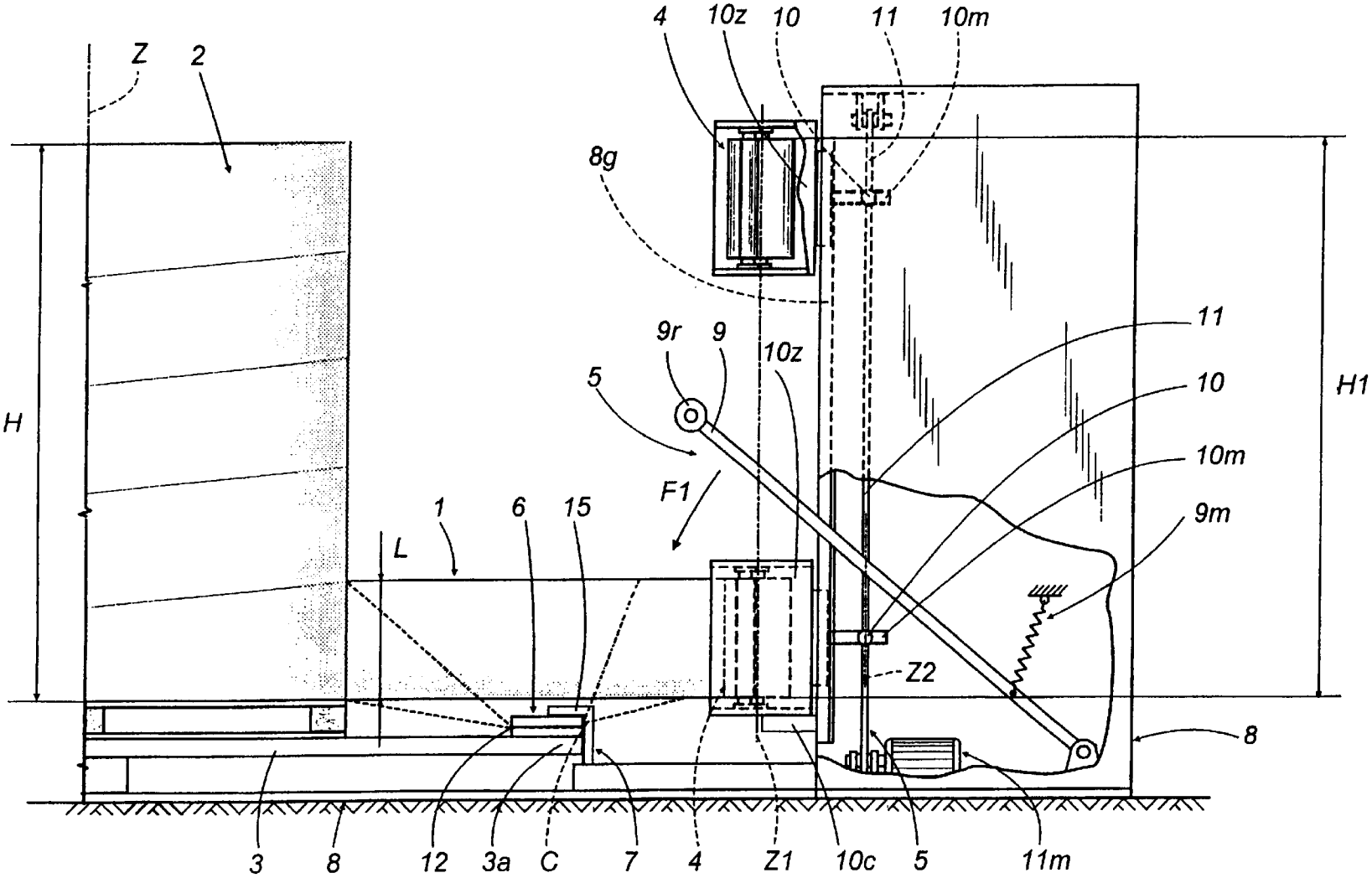
FIG. 2 is a schematic side view of the machine illustrated in FIG. 1, with some parts cut away to better illustrate others.

With reference to the accompanying drawings, in particular FIGS. 1 and 2, the method disclosed is actuated by cutting a plastic film 1 used to wrap palletised groups of products.

These groups of products are wrapped using a film with width L so that they form a pack 2 with the shape of a parallelepiped and preset height H.

The stages which allow this wrapping envisage: positioning the pack 2 on a wrapping platform 3; fixing a free edge of the film 1 at a point on the platform 3 near the pack 2 (or directly on the pack 2, but neither configuration is illustrated, since they are of the known type), then wrapping the film 1 around the pack 2 by rotating the platform 3 about a vertical axis Z.

The film 1 is unwound from a reel 4, which rotates idly about its vertical axis Z1 and moves vertically up and down between two end positions, one being the lowest position (see dashed line in FIG. 2), in which the reel 4 is near the platform 3, and the other being the highest position (see continuos line in FIG. 2), in which the reel 4 is distanced from the platform 3 at a height H1 approximately the same as the height of the pack 2.

Figure 6:
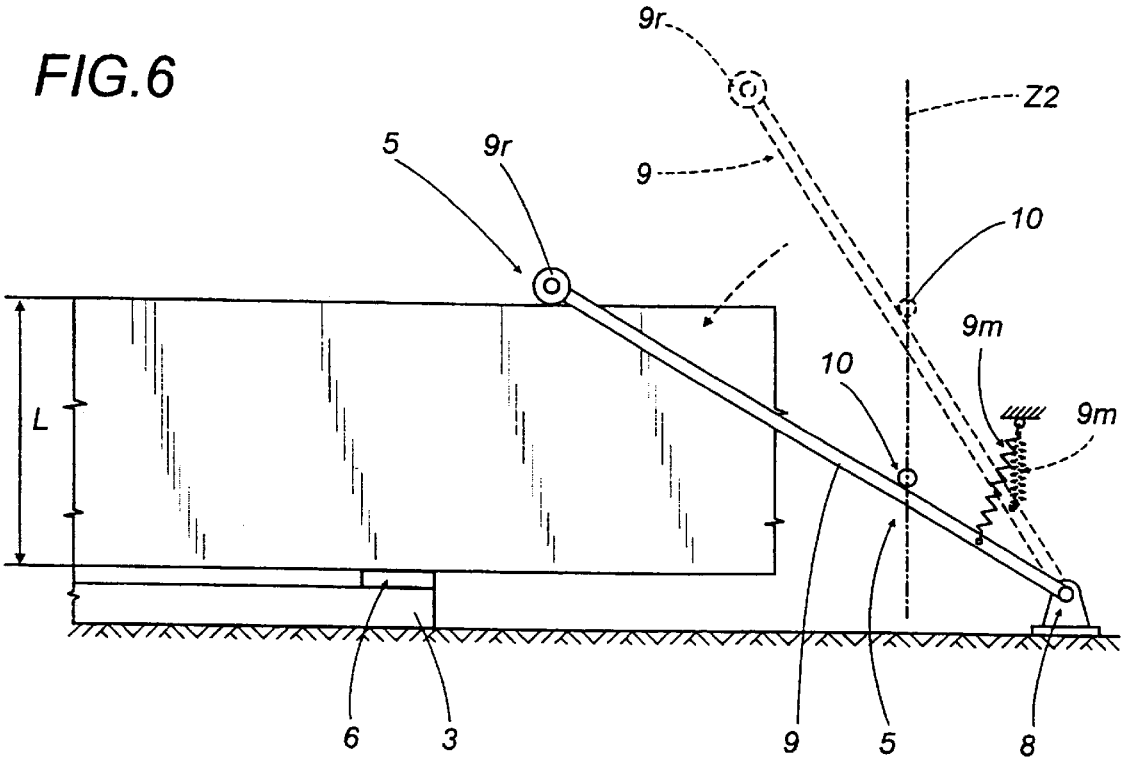
FIGS. 6 and 7 are schematic front views df a stage of the method disclosed, in particular a stage in which the width of the film is reduced.
Figure 7:
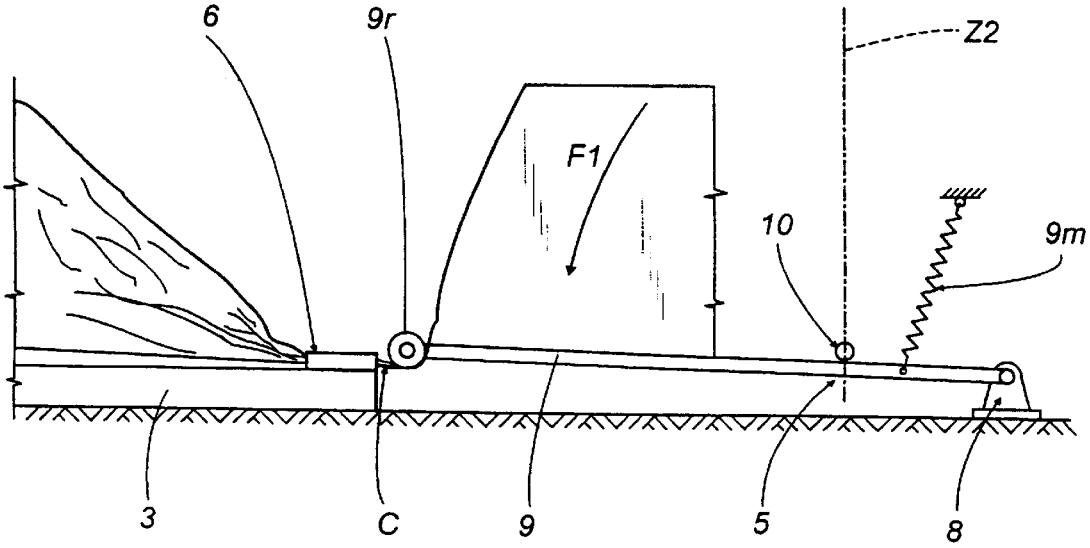

When the reel 4 is in the lowered position, that is to say, when wrapping of the pack 2 has been completed, the width L of the section of film 1 between the reel 4 and the pack 2 is reduced (see also FIGS. 6 and 7), by relative means 5 (described in the text below), until a band C of film 1 with minimum width is defined which, at least at one point, is substantially coplanar with the platform 3 which is still rotating.

Subsequently, this section of the band C of film 1 is first gripped by a cutting unit 6 (see FIG. 3) attached to the outer edge 3*a* of the platform 3, then cut by said unit 6 following rotation of the platform 3.

Figure 8:
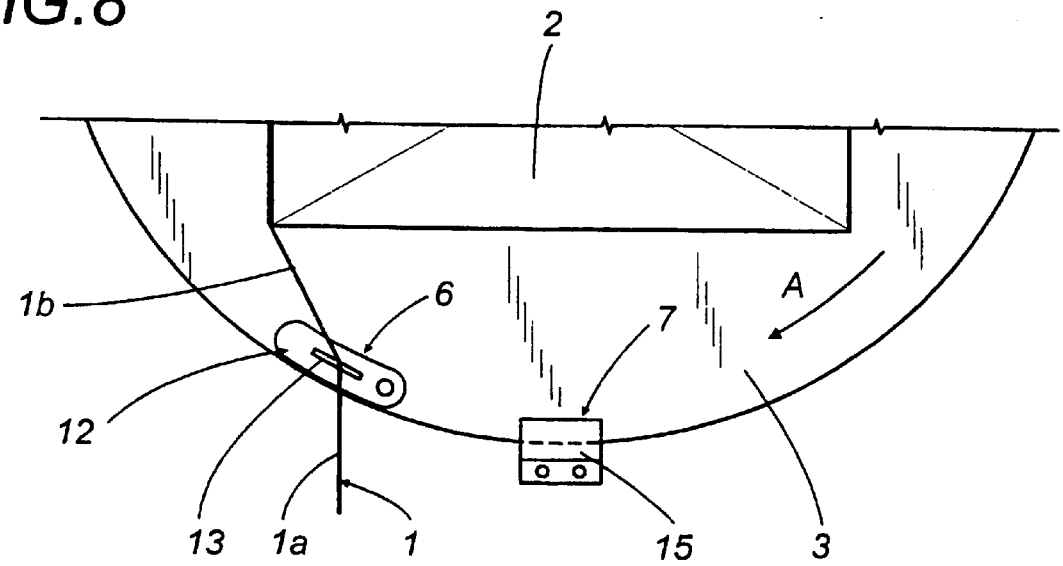
FIGS. 8 and 9 are schematic top plan views of two stages of the method disclosed, in particular the stage in which the film is cut and the stage in which the edge of the film cut is attached to another pack to be wrapped.
Figure 9:
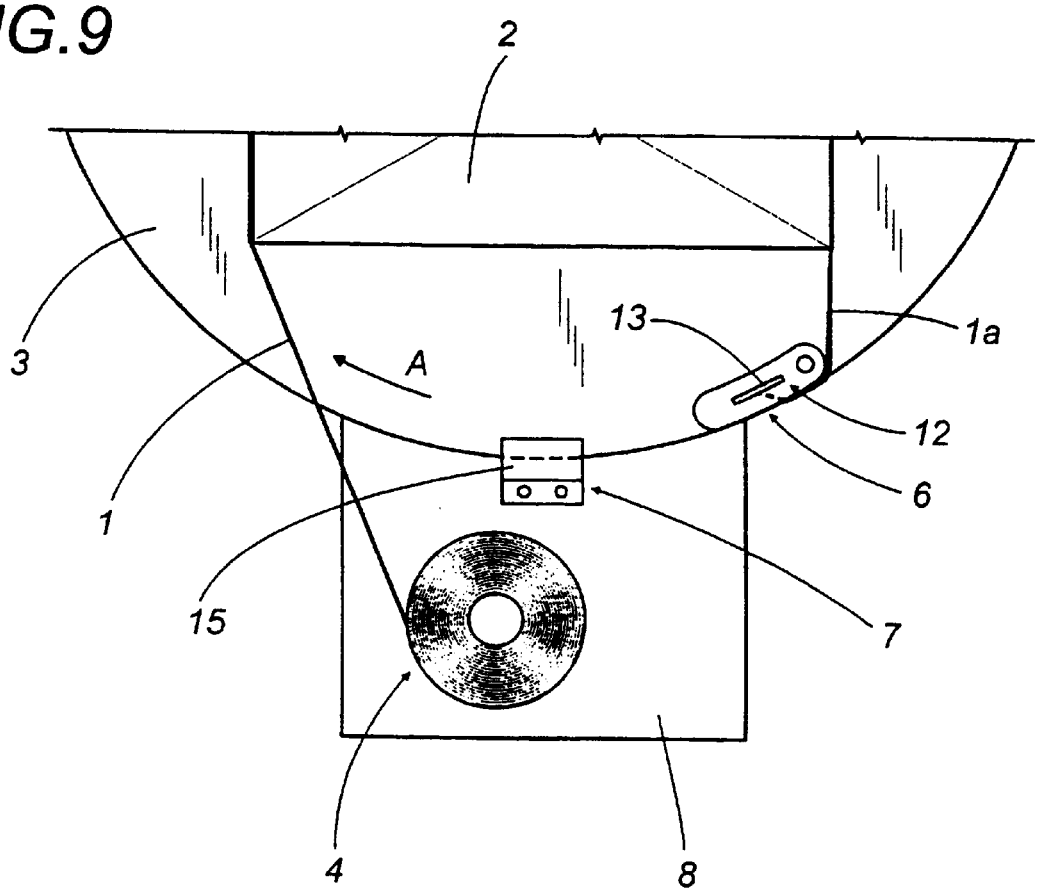

The situation just described is illustrated in FIG. 8, where the film 1 is divided into two sections, labelled 1*a* and 1*b*: the part of film 1*b* is removed when the operator picks up the pack 2, whilst the cut edge la connected to the reel 4 is first held by the gripper and cutting unit 6 during positioning of a new pack 2 to be wrapped and for a subsequent rotation of the platform 3 (see in particular FIG. 9), so as to obtain automatic re-attachment of the film to the new pack 2 to be wrapped. Once re-attached, this edge 1*a* of the film is removed when the edge is intercepted by relative first fixed cam means 7 located near the platform 3.

As an alternative to the above, see in particular FIG. 19, again following the stage at which the film 1 is gripped and cut, it is possible to carry out a further stage for removal of the cut edge or section 1*a* of film 1 by means of a flow of hot air generated by relative means 162 (more clearly described later in this text): this flow of hot air acts directly upon the edge la of the film 1 between the pack 2 and the gripper and cutting unit 6, softening the edge, so that the section then sticks to the pack 2, pushed towards the latter by the air flow.

The device which allows actuation of the above-mentioned method is applied to machines for wrapping said groups of palletised products with the plastic film 1.

Obviously, these machines comprise said platform 3, which rotates in a direction of wrapping A, the reel 4 which can rotate about its vertical axis Z1 and is supported by a frame 8 located at the side of the platform 3 and equipped with a guide 8*g*, designed to allow the reel 4 to slide vertically up and down between the above-mentioned end positions.

As already indicated, means 5 are envisaged to allow a reduction in the width L of the section of film 1 extending from the reel 4 to the pack 2, so as to define the band C of said section near the surface of the platform 3. More precisely (see FIGS. 1, 2, 6 and 7), these means 5 for reducing the width of the band C are attached to the above-mentioned frame 8, partially between the reel 4 and the platform 3 to intercept the section of film 1, and mobile along a vertical axis Z2 parallel with the vertical axis Z1 of the reel 4 and partially synchronised with said reel.

Said means 5 comprise a rod 9 positioned at the side of the reel 4 and pivoting at one end on the frame 8; at its other end, this rod 9 has an idle roller 9*r* which extends transversally relative to the section of film 1 stretching from the reel 4 to the pack 2. The rod 9 is also controlled by a guide pin 10 which is moved vertically by a chain 11 connected to the single drive means 11*m* of the pin 10 and reel 4.

During normal wrapping, the upstroke and downstroke of the pin 10 allows the reel 4 to be moved and, subsequently, the rod 9 to be angled between two end positions, one being the raised non-operating position, in which the rod 9 is almost vertical (see dashed line in FIG. 6), and a lowered operating position, in which the rod 9 is horizontal (see FIG. 7 and arrow F1) at a height lower than that of the reel 4 in its lowered position: in this way, the width of the film 1 is reduced until the band C configuration is obtained.

More precisely, the pin 10 is integral with the chain 11 and, by means of its contact with a bracket 10*m* integral with a weight 10*z*, allows the reel 4 to be raised, whilst the weight 10*z* allows constant lowering during the pin 10 downstroke.

When the reel 4 reaches the lowest position, a limit switch 10*c* locks the weight 10*z* and, therefore, also the reel, whilst the pin 10 continues its descent, pulled by the chain 11, and makes contact with the rod 9, continuing to push the latter downwards until it reaches the preset position.

Following the above-mentioned stages in which the film is cut and the edge la attached to the new pack 2 to be wrapped, the chain 11 inverts its movement, allowing the pin 10 to rise again, immediately followed by the rod 9, partly thanks to a return spring 9*m* connected to the structure 8 and the rod, then by the reel 4 so as to begin a new cycle.

The above-mentioned gripper and cutting unit 6 for the band C is, as already indicated, attached to the edge 3*a* of the platform 3, so that it is better able to intercept and cut the band C during the wrapping rotation of the platform 3. More precisely, this cutting unit 6 comprises (see also FIGS. 3, 4 and 5) a plate 12 fixed to the surface of the platform 3 and having a free end 12*a* tapered to define a guide zone for the band-shaped section C which can be inserted in and held by the plate 12 and a blade 13 housed inside the plate 12 and designed to allow cutting of the band-shaped section during rotation of the platform 3.

Figure 3:
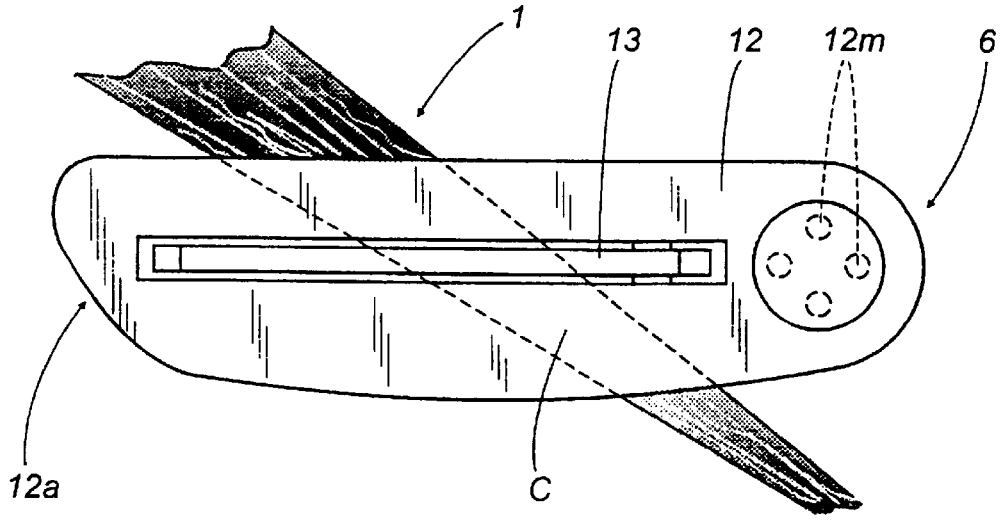
FIG. 3 is a top plan view of a scaled-up detail from FIG. 1, illustrating a film gripper and cutting unit during a stage of the method according to the present invention.
Figure 4:
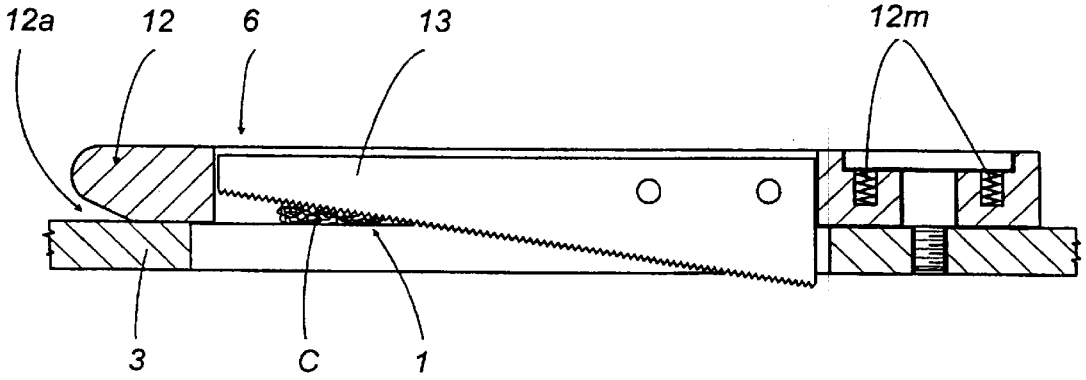
FIGS. 4 and 5 are schematic side views, partially shown in cross-section, of corresponding and different embodiments of the gripper and cutting unit illustrated in FIG. 3.
Figure 5:
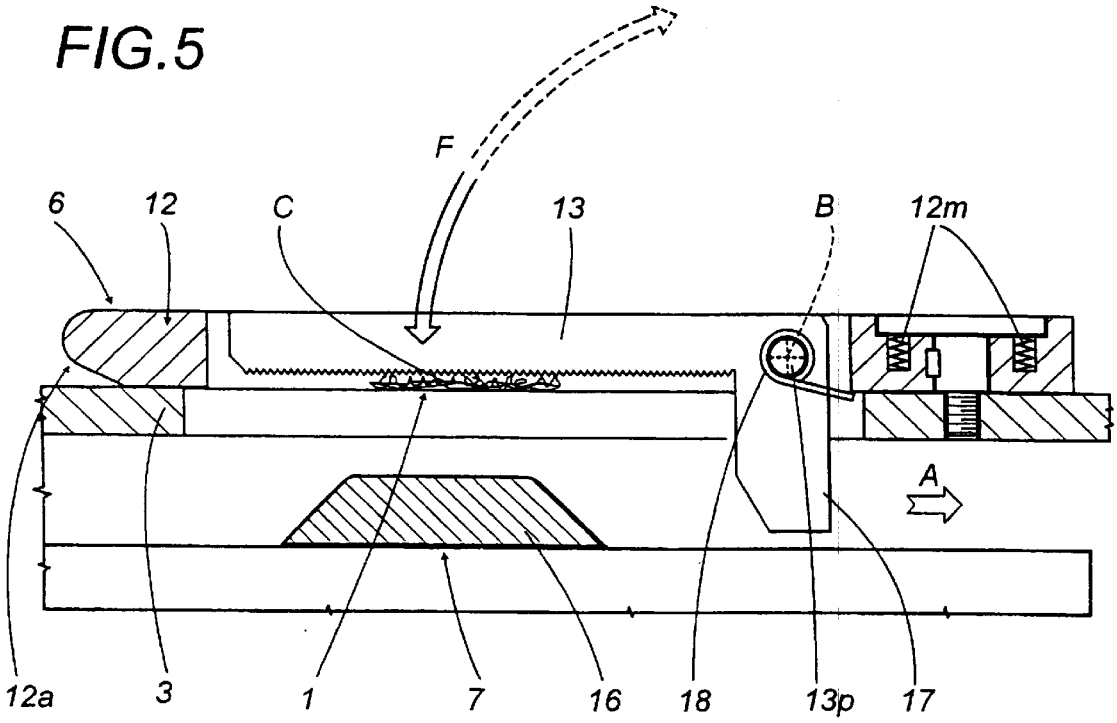

As can be observed again in FIGS. 3, 4 and 5, one end of the plate 12 is attached to the platform 3 also by spring means 12*m*, which allow both a given flexibility at the other end, designed to intercept the band C, and the return and sustained contact of said end with the platform 3 during the latter's normal rotation. As already indicated, after the band C of film 1 has been cut, the section of film 1 remaining beneath the plate 12 and attached to the reel 4 must be removed during rotation of the platform 3; the above-mentioned first fixed cam means 7, located near the platform 3, are envisaged for this purpose.

The embodiments relative to the type of blade 13 are illustrated in. FIGS. 4 and 5. In FIG. 4 the blade 13 is fixed inside the plate 12, that is to say, one end is rigidly attached to the plate 12, and it is parallel with the platform 3, so that the platform acts as the stop plane for cutting the band C.

In FIG. 5 the blade 13 pivots, at point B, inside the plate 12 and remains parallel with the platform 3 when the band C of film 1 is cut, as in the previous embodiment. In this embodiment there are second cam means 18, comprising an angled table 16 located below the platform 3 and designed to intercept a vertical lever 17 integral with the blade 13 when the platform 3 rotates: when the angled table 16 intercepts the lever 17, it allows raising to obtain film 1 cutting following the raising of the blade 13 (see arrow F in FIG. 5) and its return downstroke to the position parallel with the platform 3. The blade 13 is brought to the latter position, for example, by the action of spring means 18 located on a pivot pin 13*p* for the blade 13.

In both of the above-mentioned embodiments, said first cam means 7 comprise a pin 15 in the shape of an upturned "L" projecting above the platform 3, upstream of the reel 4 as regards the direction of wrapping A, and designed to intercept the edge of the film 1 already cut during the rotation following the cut, since the plate 12 pulls the edge of the film 1 along the edge 3*a* of the platform 3 to re-attach the film 1 to the new pack 2 to be wrapped.

Figure 11:
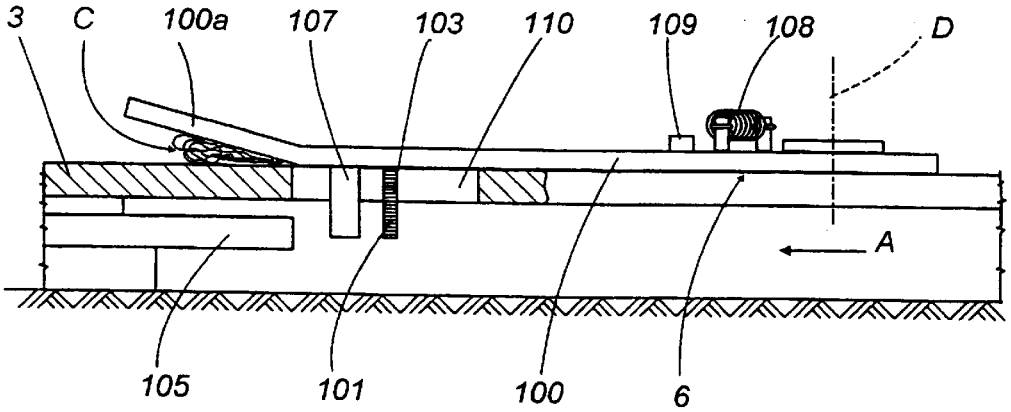
FIGS. 10 and 11 are respectively a schematic top plan view and a schematic side view partially shown in cross-section of a further embodiment of the gripper and cutting unit according to the present invention.
Figure 10:
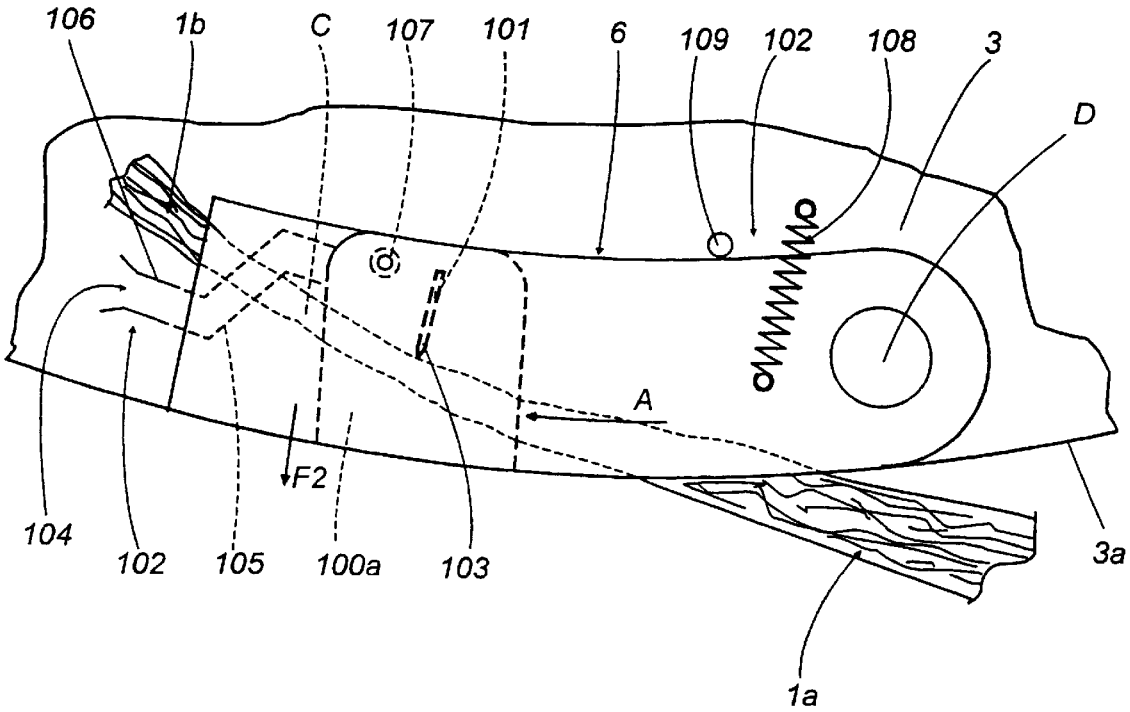
Figure 12:
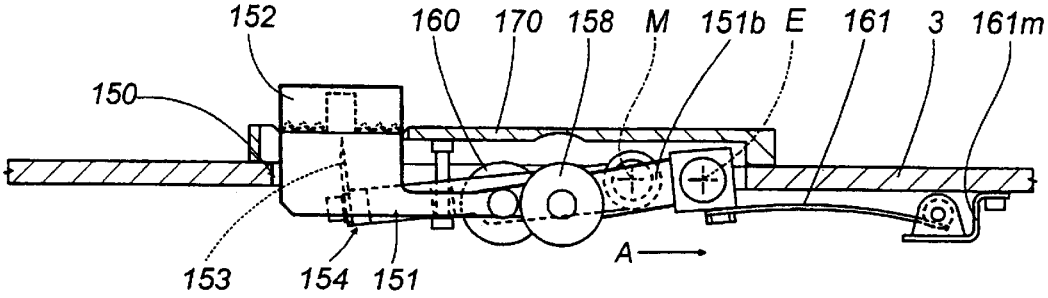
FIGS. 12, 13 and 14 illustrate another embodiment of the gripper and cutting unit according to the present invention, in three different operating positions, all being side views from N relative to the successive FIGS. 17, 18 and 19 and with some parts shown in cross-section and other parts cut away to better illustrate technical details.
Figure 13:
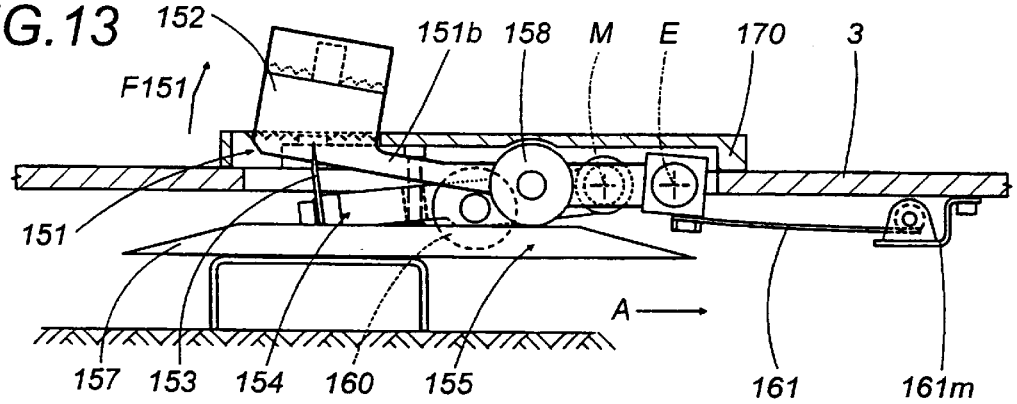

In FIGS. 10 and 11, the validity of the embodiment described is confirmed by observing a further embodiment of the gripper and cutting unit 6 for the film 1.

In this specific embodiment, said gripper and cutting unit 6 is attached to the edge 3*a* of the platform 3 and comprises a plate 100 pivoting, at point D, on the upper surface of the platform 3.

The plate 100 has a shaped free end 100*a*, angled upwards, which defines a guide zone for the band-shaped section C which is inserted in the plate 100 and held by a blade 101 fixed perpendicular to the band C and inside the plate 12.

The blade 101, with a cutting portion 103 positioned vertically and towards the outside of the platform 3, cuts the band-shaped section C resting on the blade by means of drive means 102 which move the plate 100 between a cutting position, in which it cuts the film 1 inserted and in which the plate 100 is turned towards the outside (see arrow F2 in FIG. 10), and a home position and/or position in which it holds the cut edge 1*a* of the film 1, in which the plate 100 is housed inside the platform 3.

More precisely, the plate 100 drive means 102 comprise a cam profile 104 defined by a pair of fixed walls 105 and 106 below the platform 3 which, when the platform 3 rotates, are intercepted by a first vertical cam follower pin 107 fixed inside the plate 100, and located upstream of the blade 101 relative to the direction of rotation A of the platform 3, allowing the above-mentioned cutting position. The blade 101 and pin 107 project from the bottom of the platform 3 thanks to a through-hole 110 in the platform.

To make the plate 100 return to the home position and/or holding position, there are spring means 108, with one end connected to the plate 100 and the other fixed to the platform 3; the platform 3 stable return position is given by a second vertical, end of stroke pin 109, again fixed to the platform 3.

This embodiment allows said release of the section la of film 1 cut from the plate 100 without the aid of the above-mentioned cam means 7 since, during the rotation following film 1 cutting, the rotation of the plate 100 allows the edge to exit the plate thanks to the fact that the film slide over the plate and the edge la already moved to the outer end of the plate 100 during the previous, cutting stage.

FIGS. 12 to 19 illustrate another embodiment of the above-mentioned gripper and cutting unit 6 for the band C of film 1. This unit 6 is attached to and located at the upper surface of the platform 3 (that is to say, partially inside the platform), which has a special through-hole 150 in its surface.

This unit 6 comprises (see in particular FIGS. 15 and 16) a gripper 151, pivoting by its arm 151*b*, at point E, on the platform 3 and with an operating end 152 which lies opposite and operates with a corresponding cutting portion 153 of a blade 154, pivoting by its arm 154*b*, at point M, on the platform 3. In addition to these two elements, there is a frame 170 fixed to the platform 3 and designed to cover the edge of said hole 150. Said frame also has a serrated contact profile 171 near to the zone in which the gripper 151 and blade 154 operate.

The gripper 151 and blade 154 are driven by first and second cam means 155 and 156, allowing them to move independently but in a coordinated manner, again during rotation of the platform 3 in direction A, designed to allow respectively the interception, holding and cutting of a section of the band C as described for the previous embodiments.

More precisely, the above-mentioned first cam means 155 comprise a first fixed wall 157, located below the platform 3, which extends in the shape of an arc and has a substantially trapezoidal profile, designed to be intercepted by a first cam follower roller 158, attached in such a way that it can rotate at an intermediate point of the arm 151*b* of the gripper 151, that is to say, between the pivot point E and the operating end 152.

Figure 14:
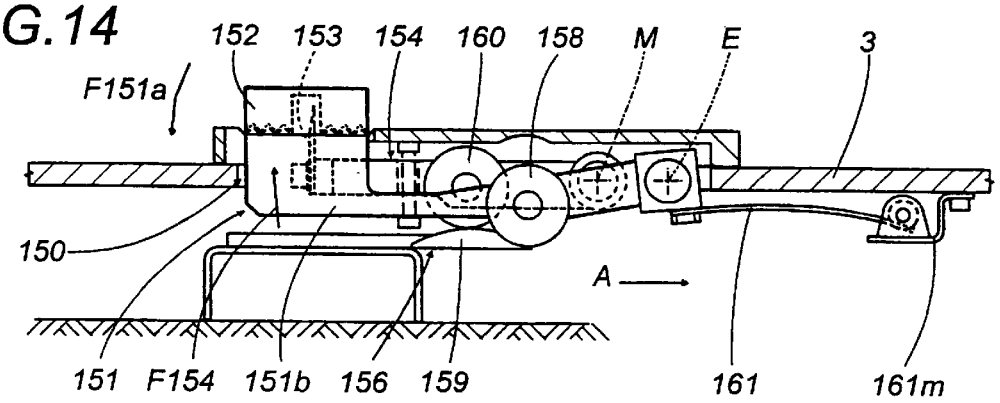
Figure 15:
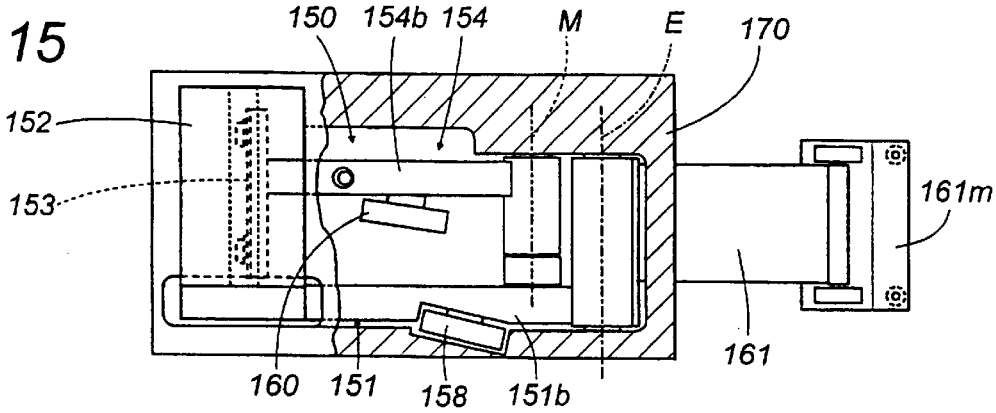
FIG. 15 is a top plan view of the gripper and cutting unit relative to FIGS. 12 and 14, with some parts cut away to better illustrate others.
Figure 16:
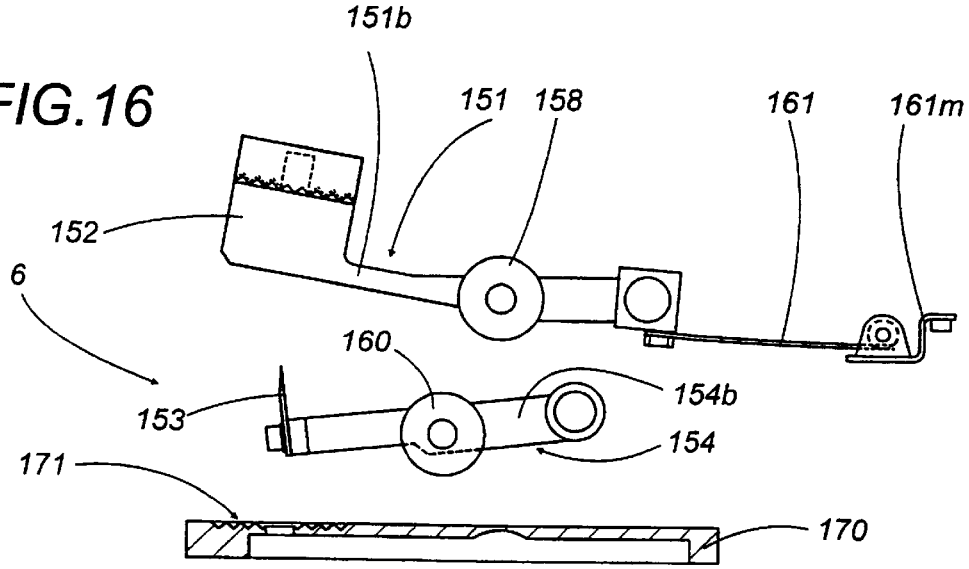
FIG. 16 is an exploded side view of the parts of which the gripper and cutting unit in FIGS. 12 and 14 consists.
Figure 17:
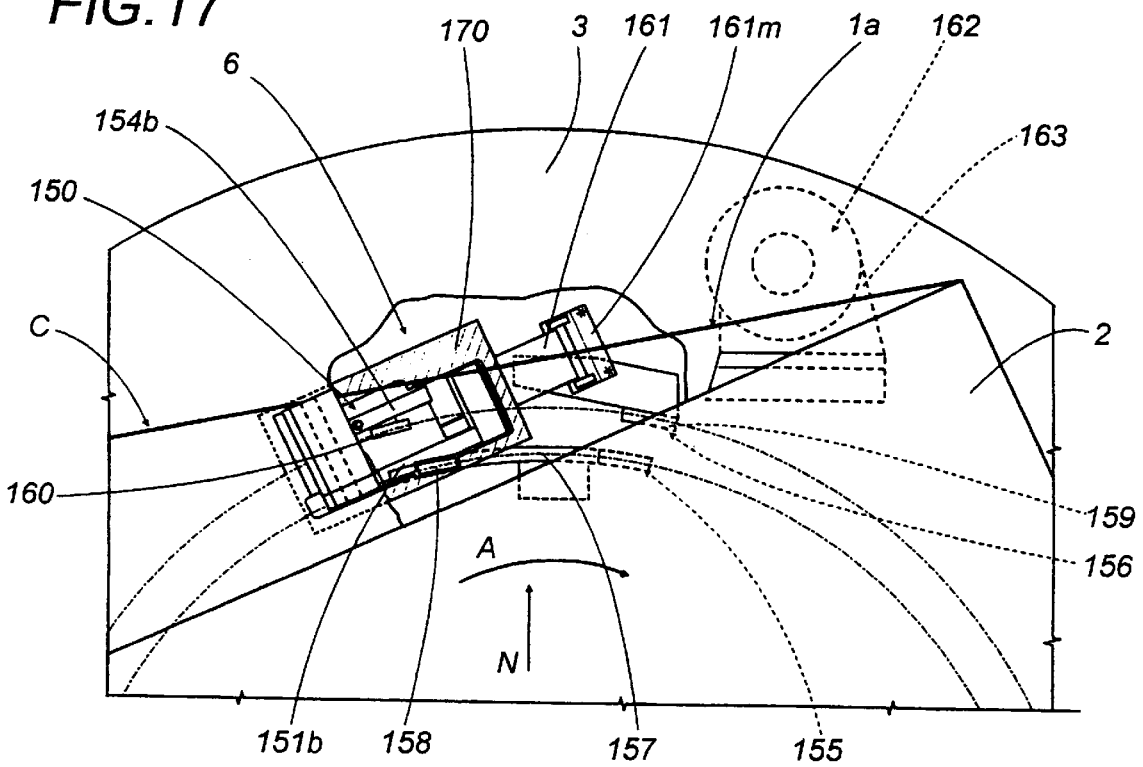
FIGS. 17, 18 and 19 are top plan views of a part of the machine for wrapping groups of products equipped with the unit illustrated in FIGS. 12 and 14 in three different operating configurations and with a further device for heating and detaching the final section of the film, with some parts cut away to better illustrate others.
Figure 18:
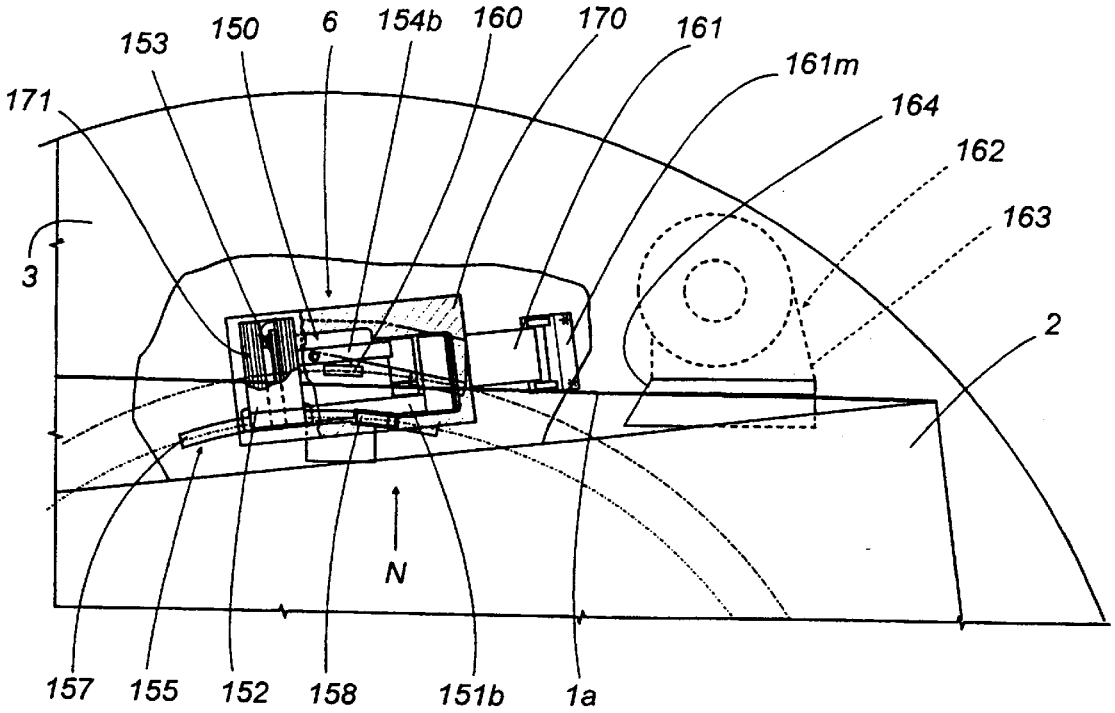
Figure 19:
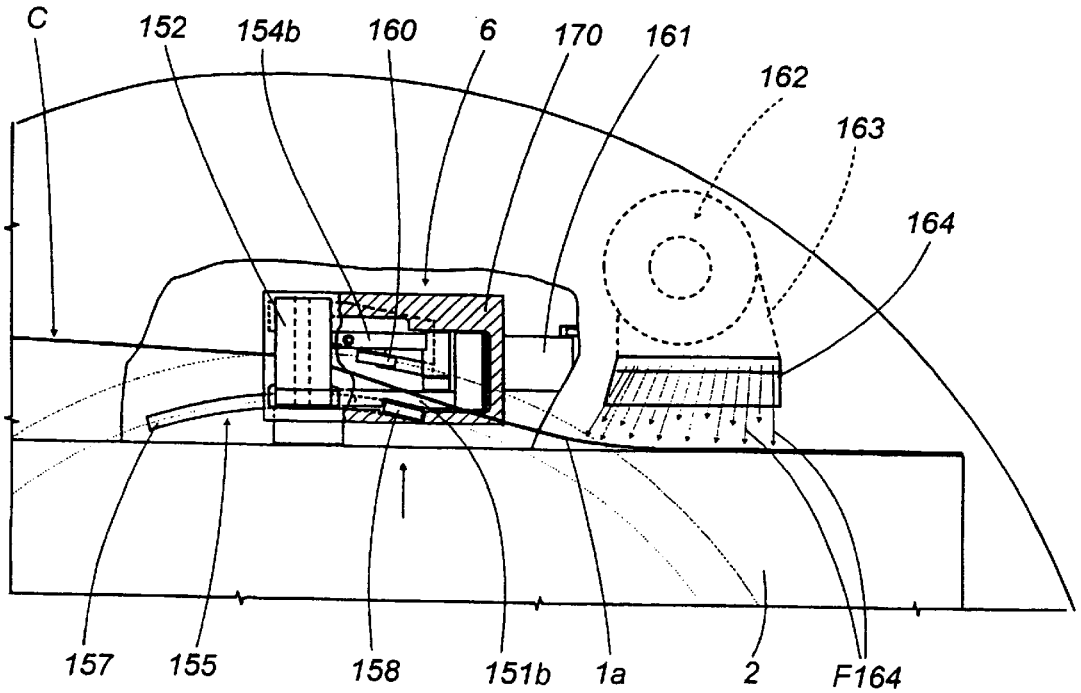

This configuration allows the gripper to be moved between several positions: a non-operating position, in which the gripper 151 is substantially parallel with the platform 3 (see FIGS. 12 and 17); and an operating gripping position, in which the gripper 151 is raised and angled relative to the platform 3, so that it intercepts the section of band C created by the width reduction means 5 (see arrow F151 in FIG. 13 and the straight section of the wall 157, also visible in FIG. 18); finally, an operating cutting position, in which the gripper 151 is again parallel with the platform 3, allowing cutting of the section of band C in co-operation with the blade 154 (see arrow FISla in FIG. 14 and FIG. 19).

Again as can be observed in FIGS. 12 to 16, the gripper 151 have spring means 161 which operate between the end of the gripper 151 opposite the operating end 152 and the platform 3: this is a leaf spring 161 supported by a bracket 161*m* attached to the platform 3 and designed to hold or return the gripper 151 in the lowered, non-operating position, keeping it there when not intercepted by the above-mentioned cam means 155.

The blade 154 is moved by the above-mentioned second cam means 156, which comprise a second fixed wall 159 which extends in the shape of an arc, located beside the wall 157, and having a convex profile designed to be intercepted by a second cam follower roller 160 attached in such a way that it can rotate to the arm 154*b* of the blade 154, so that it allows the blade to be moved between two end positions: a lowered non-operating position, in which the blade 154 is angled and below the platform 3 (see FIGS. 12 and 13), and a raised operating position, in which the blade 154 is parallel with the platform 3, with at least the cutting portion 153 above the platform to intercept and cut the section of the band C of film 1 simultaneous with the lowering of the gripper 151 (see FIG. 14 and arrow F154 and FIG. 19). Thus, when the gripper 151 is lowered and the blade 154 is raised, the section la of the band C is cut and locked.

When the platform is stationary (see again FIG. 19) and unit 6 is in the above-mentioned configuration, said heating means 162 for the section 1*a* of the band C can operate directly on the band, allowing the section of band C to be removed from the gripper and cutting unit 6 when said unit is activated: in this way, the section la is both removed from the unit 6 and stuck to the side of the pack 2 located near the section.

More precisely, these heating means 162 comprise a fan unit 163 for heated air (of the known type, therefore illustrated only schematically) located below the platform 3 and which, upon completion of wrapping, can be positioned opposite a through-hole 164 in the platform 3 near the gripper and cutting unit 6: this hole 164 may be shaped so as to direct the flow F164 of hot air onto an area of film 1 sufficient to simultaneously soften the film and transfer it towards the pack 2, allowing it to stick to the latter.

This method and the relative device, therefore, allow the above-mentioned objects to be achieved: the machine is not excessively modified compared with the known embodiment, thus maintaining a high level of reliability and practicality; the application of the width reduction, gripper and cutting units does not lead to an excessive increase in the cost of the machine, but allows the automation of two stages (film cutting and re-attachment) until now effected manually.

The present invention may be subject to numerous modifications and variations, all encompassed by the original design concept. Moreover, all components may be replaced with technically equivalent parts

What is claimed is:

1. A device for cutting a plastic film (1) with width (L), used to wrap groups of palletized products in machines comprising:

a platform (3) rotating about a first vertical axis (Z) in a direction of wrapping (A) and supporting on a surface thereof a group of products to be wrapped to form a pack (2), by said rotation of the platform (3), with the film (1), wherein a free edge of the film is attached to the platform (3);

a reel (4) supported for rotation about a second vertical axis (Z1), said reel holding film that can be unwound therefrom and being supported by a frame (8) located adjacent the platform (3) and allowing the reel (4) to be moved vertically up and down, during said wrapping, between two end positions, one of said end positions being the lowest, in which the reel (4) is adjacent the platform (3), and the other of said end positions being the highest, in which the reel (4) is distanced from the platform (3) at a height (H1) approximately the same as the height (H) of the pack (2);

means (5) for reducing the width (L) of a section of film (1) extending from the reel (4) to the pack (2), thereby defining a band (C) of the section adjacent the surface of the platform (3); and, a gripper and cutting unit (6) for the band shaped section (C), said gripper and cutting unit attached to the platform (3) and intercepting and cutting the band (C) when the platform (3) performs a wrapping rotation, wherein the means (5) for reducing the width of the band (C) of film (1) are attached to the frame (8), between the reel (4) and platform (3), and movable along a third vertical axis (Z2) parallel with the second vertical axis (Z1) of the reel (4) and partially synchronized with the reel, said width reduction means (5) comprising:

a rod (9), pivoting at one end on the frame (8) and including an idle roller (9*r*) for contact with the film (1) and extending transversely relative to the section of film (1), said rod (9) being controlled by a guide pin (10), the latter being vertically mobile by means of a motor-powered chain (11) also acting upon the reel (4), said pin (10) angling the rod (9) between two end positions, one being a raised, non-operating position, in which the rod (9) is distanced from the film (1), and the other being a lowered, operating position, in which the rod (9) is horizontal and at a height lower than the height of the reel (4) in its lowered position, allowing the roller (9*r*) to reduce the width of the band (C).

2. The device according to claim 1, wherein the gripper and cutting unit (6) is attached to the edge (3*a*) of the platform (3) and comprises a plate (12), said plate being fixed to the surface of the platform (3) and having a free end (12*a*) tapered to define a guide zone for the band-shaped section (C), whereby said band-shaped section is inserted and held between the plate (12) and a blade (13), said blade being housed inside the plate (12) and designed to cut the band-shaped section.

3. The device according to claim 2, wherein the blade (13) is fixed inside the plate (12) and positioned parallel with the platform (3).

4. The device according to claim 2, wherein the blade (13) pivots, at a point (B), inside the plate (12) and wherein the blade is positioned parallel with the platform (3) when the band (C) of film (1) is cut; said device further comprising:

means (16, 18) operating on the blade (13) for raising the blade and returning the blade to a position parallel with the platform (3).

5. The device according to claim 4, wherein the blade operating means (16) comprise:

second cam means, comprising an angled table (16), being located below the platform (3) and designed to intercept a vertical lever (17) integral with the blade (13), when the platform (3) rotates; and, spring means (18) for returning the blade to a position parallel with the platform (3).

6. The device according to claim 1, further comprising:

first fixed cam means (7) located adjacent the platform (3) and allowing removal of an edge (1*a*) of the cut film (1) extending from the gripper and cutting unit (6) to the reel (4) when the platform (3) performs a subsequent rotation.

7. The device according to claim 6, wherein the first cam means (7) comprises a pin (15) in the shape of an upturned "L" projecting above the platform (3) and being designed to intercept the edge (1*a*) of the cut film (1).

8. The device according to claim 1, wherein the gripper and cutting unit (6) is attached to the edge (3*a*) of the platform (3) and comprises a plate (100), said plate pivoting at point (D) on the surface of the platform (3) and having a free end (10*a*) shaped to form a guide zone for the band-shaped section (C), wherein said band-shaped section is selectively insertable and held between a blade (101) and the plate; said blade (101) being fixed inside the plate (100) and perpendicular to the band (C) and allowing the band-shaped section (C) to be cut by means (102) which act upon the plate (100), said means allowing the plate to be moved between a position for cutting the inserted film (1), in which the plate (100) is turned towards the outside, and a home position, or position for holding an edge (1*a*) of the film (1), in which the plate (100) is housed inside the platform (3).

9. The device according to claim 8, wherein the blade (101) has a cutting portion (103) positioned vertically and directed towards the outside of the platform (3).

10. The device according to claim 8, wherein the drive means (102) for the plate (100) comprise:

a cam profile (104), being defined by a pair of fixed walls (105, 106) located below the platform (3) and being intercepted, when the platform (3) rotates, by a first vertical cam follower pin (107) fixed to fixed to the plate (100), being upstream of the blade (101) relative to the direction of rotation (A) of the platform (3), allowing the cutting position to be achieved; and, spring means (108) operating upon the plate (100) and fixed to the platform (3), and allowing the plate to return to the home position in co-operation with a second, end of stroke pin (109), the latter being fixed to the platform (3).

11. A device for cutting a plastic film (1) with width (L), used to wrap groups of palletized products in machines comprising:

a platform (3) rotating about a first vertical axis (Z) in a direction of wrapping (A) and supporting on a surface thereof a group of products to be wrapped to form a pack (2), by said rotation of the platform (3), with the film (1), wherein a free edge of the film is attached to the platform (3);

a reel (4) supported for rotation about a second vertical axis (Z1), said reel holding film that can be unwound therefrom and being supported by a frame (8) located adjacent the platform (3) and allowing the reel (4) to be moved vertically up and down, during said wrapping, between two end positions, one of said end positions being the lowest, in which the reel (4) is adjacent the platform (3), and the other of said end positions being the highest, in which the reel (4) is distanced from the platform (3) at a height (H1) approximately the same as the height (H) of the pack (2);

means (5) for reducing the width (L) of a section of film (1) extending from the reel (4) to the pack (2), thereby defining a band (C) of the section adjacent the surface of the platform (3); and, a gripper and cutting unit (6) for the band shaped section (C), said gripper and cutting unit attached to the platform (3) and intercepting and cutting the band (C) when the platform (3) performs a wrapping rotation, said gripper and cutting unit (6) attached to and located at the upper surface of the platform (3), there being a through-hole (150) in the platform, said gripper and cutting unit (6) comprising a gripper (151), pivoting at point (E) on the platform (3) and having an operating end (152) opposite and co-operating with a corresponding cutting portion (153) of a blade (154), the latter pivoting at point (M) on the platform (3); first cam means (155) and second cam means (156) operating upon the gripper (151) and on the blade (154), respectively, allowing their independent and coordinated movement during rotation of the platform (3), allowing a section of the band (C) to be intercepted, held and then cut.

12. The device according to claim 11, wherein the first cam means (155) comprise a first fixed wall (157), being positioned below the platform (3) and extending in the shape of an arc, with a substantially trapezoidal profile, and intercepted by a first cam follower roller (158), the roller rotatable attached to an intermediate point of the gripper (151) between the pivot point (E) and the operating end (152), allowing the gripper to be moved between several positions, at least one being a non-operating position, in which the gripper (151) is substantially parallel with the platform (3), an operating gripping position, in which the gripper (151) is raised and angled relative to the platform (3)so as to intercept the section of band (C), and an operating cutting position, in which the gripper (151) is parallel with the platform (3), allowing cutting of the band (C) in cooperation with the blade (154).

13. The device according to claim 12, wherein that the gripper (151) comprises spring means (161) operating between the end of the gripper (151) opposite the operating end (152) and the platform (3), said siring means (161) holding the gripper (151) in and return it to the lowered non-operating position.

14. The device according to claim 11, wherein the second cam means (156) comprise a second fixed wall (159), extending in the shape of an arc, with a convex profile, being designed to intercept a second cam follower roller (160), the roller being rotatable attached to the blade (154), thus allowing the blade to be moved between two end positions, one of said end positions being a lowered non-operating position, in which the blade (154) is angled and below the platform (3), the other of said end positions being a raised operating position, in which the blade (154) is parallel with the platform (3) and with at least the cutting portion (153) above the platform so as to intercept the section of the band (C) of film.

15. The device according to claim 11, wherein that the gripper (151) comprises spring means (161) operating between the end of the gripper (151) opposite the operating end (152) and the platform (3), said spring means (161) holding the gripper (151) in and return it to the lowered non-operating position.

* * * * *